US011634870B2

(12) United States Patent
Rouse et al.

(10) Patent No.: US 11,634,870 B2
(45) **Date of Patent: *Apr. 25, 2023**

(54) LAYERED TISSUE COMPRISING NON-WOOD FIBERS

(71) Applicant: Kimberly-Clark Worldwide, Inc., Neenah, WI (US)

(72) Inventors: Kayla Elizabeth Rouse, Appleton, WI (US); Richard Louis Underhill, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 65 days.

This patent is subject to a terminal disclaimer.

(21) Appl. No.: 17/338,917

(22) Filed: Jun. 4, 2021

(65) Prior Publication Data

US 2021/0292973 A1 Sep. 23, 2021

Related U.S. Application Data

(63) Continuation of application No. 16/483,115, filed as application No. PCT/US2017/018822 on Feb. 22, 2017, now Pat. No. 11,053,643.

(51) Int. Cl.

| | |
|---|---|
| ***D21H 27/38*** | (2006.01) |
| ***D21H 11/12*** | (2006.01) |
| ***D21H 27/00*** | (2006.01) |
| ***D21F 11/04*** | (2006.01) |

(52) U.S. Cl.
CPC ..... *D21H 27/38* (2013.01); *D21F 11/04* (2013.01); *D21H 11/12* (2013.01); *D21H 27/005* (2013.01)

(58) Field of Classification Search
CPC ..... D21H 27/38; D21H 11/12; D21H 27/005; D21H 27/002; D21H 27/30; D21F 11/04
See application file for complete search history.

(56) References Cited

U.S. PATENT DOCUMENTS

| | | | | |
|---|---|---|---|---|
| 3,004,884 | A | 10/1961 | Eberl et al. | |
| 3,994,771 | A | 11/1976 | Morgan et al. | |
| 4,300,981 | A | 11/1981 | Carstens | |
| 4,464,224 | A | 8/1984 | Matolcsy | |
| 4,857,145 | A | 8/1989 | Villavicencio | |
| 5,320,710 | A | 6/1994 | Reeves et al. | |
| 5,348,620 | A | 9/1994 | Hermans et al. | |
| 5,472,569 | A | 12/1995 | Nicolucci et al. | |
| 5,607,551 | A | 3/1997 | Farrington et al. | |
| 5,656,132 | A | 8/1997 | Farrington et al. | |
| 5,932,068 | A | 8/1999 | Farrington et al. | |
| 6,171,442 | B1 | 1/2001 | Farrington, Jr. et al. | |
| 6,174,412 | B1 | 1/2001 | Paterson-Brown et al. | |
| 6,248,211 | B1 | 6/2001 | Jennings et al. | |
| 6,258,207 | B1 | 7/2001 | Pan | |
| 6,302,997 | B1 | 10/2001 | Hurter et al. | |
| 6,455,129 | B1 | 9/2002 | Kershaw et al. | |
| 6,511,579 | B1 | 1/2003 | Edwards et al. | |
| 6,709,550 | B2 | 3/2004 | Holz et al. | |
| 6,796,114 | B2 | 9/2004 | Sheedy et al. | |
| 6,797,114 | B2 | 9/2004 | Hu | |
| 6,821,387 | B2 | 11/2004 | Hu | |
| 7,156,954 | B2 | 1/2007 | Farrington, Jr. et al. | |
| 7,166,190 | B2 | 1/2007 | Graef et al. | |
| 7,682,488 | B2 | 3/2010 | Yeh et al. | |
| 8,049,060 | B2 | 11/2011 | Vinson et al. | |
| 8,524,374 | B2 | 9/2013 | Shannon | |
| 8,574,400 | B1 | 11/2013 | Shannon et al. | |
| 8,741,104 | B2 | 6/2014 | Edwards et al. | |
| 8,778,505 | B2 | 7/2014 | Shannon | |
| 9,074,324 | B2 * | 7/2015 | Shannon | D21H 11/12 |
| 9,222,224 | B2 | 12/2015 | Shannon | |
| 9,410,291 | B2 * | 8/2016 | Shannon | D21H 11/04 |
| 9,447,545 | B2 | 9/2016 | Hermans et al. | |
| 10,132,036 | B2 | 11/2018 | Collins et al. | |
| 10,145,066 | B2 | 12/2018 | Shannon et al. | |
| 10,145,069 | B2 | 12/2018 | Shannon et al. | |
| 10,337,149 | B2 | 7/2019 | Rouse et al. | |
| 10,428,465 | B2 | 10/2019 | Rouse et al. | |
| 10,550,522 | B2 | 2/2020 | Shannon et al. | |
| 11,053,643 | B2 * | 7/2021 | Rouse | D21H 11/12 |
| 11,261,568 | B2 * | 3/2022 | Rouse | D21H 27/00 |

(Continued)

FOREIGN PATENT DOCUMENTS

| | | | |
|---|---|---|---|
| CA | 2076615 | A1 | 10/1993 |
| CA | 2168894 | A1 | 8/1997 |

(Continued)

OTHER PUBLICATIONS

Deniz et al. in "Kraft and Modified Kraft Pulping of Bamboo (*Phyllostachys bambusoides*)," Drewno 2017, vol. 60, No. 200.

Economic Research Services: "Natural Fibers Hesperaloe Has Properties That Interest Papermakers", Sep. 1, 1996 (Sep. 1, 1996), XP055526919, Retrieved from the Internet: URL: https://www.ers.usda.gov/webdocs/publications/37342/32911_ius6d_002.pdf?v=41471 [retrieved on Nov. 26, 2018].

Escoto-Garcia, T. et al., "Fermentative-Chemical and Mechanical Treatment of Agave Bagasse (*Agave tequilana* Weber) for its Application in Hand Crafted Paper," Revista Mexicana de Ingenieria Quimica, Nov. 30, 2006, vol. 5, No. Suppl. 1, pp. 23-27.

Eugenio et al., in "Evalution of Hesperaloe funifera pulps obtained by a low energy consumption process as a reinforcement material in reycled pulps," Forest Systems 21(3) pp. 460-467. (Year: 2012).

(Continued)

*Primary Examiner* — Jose A Fortuna

(74) *Attorney, Agent, or Firm* — Kimberly-Clark Worldwide, Inc.

(57) ABSTRACT

The present invention provides multi-layered tissue webs, and tissue products comprising the same, the multi-layered webs comprising wood fibers and non-wood cellulosic fibers where the non-wood cellulosic fibers are selectively deposited in one or more outer layers of the multi-layered web. Surprisingly disposing non-wood cellulosic fibers in the outer layers, even in relatively modest amounts, alters the machine and/or cross-machine direction properties of the resulting web, such that MD:CD tensile ratio may be reduced.

14 Claims, 2 Drawing Sheets

(56) References Cited

U.S. PATENT DOCUMENTS

Figure 1:
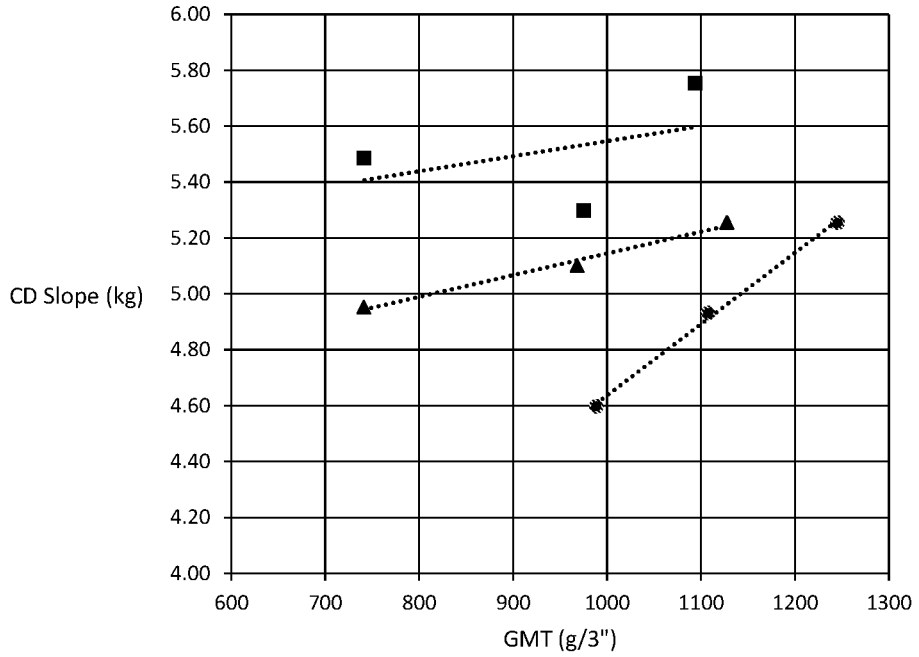

| | | | | |
|---|---|---|---|---|
| 2002/0096287 | A1 | 7/2002 | Jewell et al. | |
| 2002/0134520 | A1 | 9/2002 | Behnke et al. | |
| 2002/0148574 | A1 | 10/2002 | Van Draanen et al. | |
| 2002/0148584 | A1 | 10/2002 | Edwards et al. | |
| 2003/0111197 | A1 | 6/2003 | Hu | |
| 2003/0121629 | A1 | 7/2003 | Hu | |
| 2003/0192662 | A1 | 10/2003 | Heath et al. | |
| 2003/0196772 | A1 | 10/2003 | Awofeso et al. | |
| 2004/0084165 | A1 | 5/2004 | Shannon et al. | |
| 2004/0140076 | A1 | 7/2004 | Hermans et al. | |
| 2004/0168780 | A1 | 9/2004 | Dwiggins et al. | |
| 2004/0194901 | A1 | 10/2004 | Hu et al. | |
| 2004/0226673 | A1 | 11/2004 | Edwards et al. | |
| 2005/0236122 | A1 | 10/2005 | Mullally et al. | |
| 2006/0288639 | A1 | 12/2006 | Vinson et al. | |
| 2007/0011762 | A1 | 1/2007 | Vinson et al. | |
| 2007/0051484 | A1 | 3/2007 | Hermans et al. | |
| 2007/0107863 | A1 | 5/2007 | Edwards et al. | |
| 2007/0298995 | A1 | 12/2007 | Eggers et al. | |
| 2008/0008853 | A1 | 1/2008 | Hupp et al. | |
| 2009/0068633 | A1 | 3/2009 | Cohen et al. | |
| 2009/0266500 | A1 | 10/2009 | Schubert et al. | |
| 2010/0032113 | A1 | 2/2010 | Awofeso et al. | |
| 2010/0043989 | A1 | 2/2010 | Shannon et al. | |
| 2010/0126685 | A1 | 5/2010 | Fike et al. | |
| 2011/0017631 | A1 | 1/2011 | Sheasley | |
| 2011/0168342 | A1 | 7/2011 | Mohammadi | |
| 2011/0297343 | A1 | 12/2011 | Li et al. | |
| 2011/0303375 | A1 | 12/2011 | Shannon et al. | |
| 2012/0018964 | A1 | 1/2012 | Edelblut | |
| 2013/0068867 | A1 | 3/2013 | Hermans et al. | |
| 2013/0068868 | A1 | 3/2013 | Hermans et al. | |
| 2013/0071655 | A1 | 3/2013 | Zwick et al. | |
| 2013/0071678 | A1 | 3/2013 | Shannon | |
| 2013/0199741 | A1 | 8/2013 | Stage et al. | |
| 2013/0269892 | A1 | 10/2013 | Hermans et al. | |
| 2013/0299107 | A1 | 11/2013 | Shannon | |
| 2013/0312924 | A1 | 11/2013 | Shi et al. | |
| 2014/0093704 | A1 | 4/2014 | Shi et al. | |
| 2014/0093705 | A1 | 4/2014 | Shi et al. | |
| 2014/0205777 | A1 | 7/2014 | Hawkins et al. | |
| 2014/0284010 | A1 | 9/2014 | Shannon | |
| 2015/0129143 | A1 | 5/2015 | Hawkins et al. | |
| 2015/0144280 | A1* | 5/2015 | Shannon | D21H 11/04 162/111 |
| 2016/0130762 | A1 | 5/2016 | Ramaratnam et al. | |
| 2016/0138224 | A1* | 5/2016 | Shannon | D21H 27/30 162/129 |
| 2016/0145809 | A1 | 5/2016 | Hermans et al. | |
| 2016/0355987 | A1 | 12/2016 | Hermans et al. | |
| 2017/0254025 | A1 | 9/2017 | Miller et al. | |
| 2018/0030654 | A1 | 2/2018 | Chute | |
| 2018/0044859 | A1 | 2/2018 | Hermans et al. | |
| 2018/0135248 | A1 | 5/2018 | Collins et al. | |
| 2018/0135249 | A1 | 5/2018 | Shannon et al. | |
| 2018/0142419 | A1 | 5/2018 | Rouse et al. | |
| 2018/0142420 | A1 | 5/2018 | Rouse et al. | |
| 2018/0142421 | A1 | 5/2018 | Rouse et al. | |
| 2019/0100878 | A1 | 4/2019 | Shannon et al. | |
| 2019/0249367 | A1 | 8/2019 | Rouse et al. | |
| 2019/0264395 | A1 | 8/2019 | Rouse et al. | |
| 2019/0276985 | A1 | 9/2019 | Anderson et al. | |
| 2020/0040529 | A1 | 2/2020 | Rouse et al. | |
| 2020/0102705 | A1 | 4/2020 | Rouse et al. | |
| 2020/0115853 | A1 | 4/2020 | Shannon et al. | |
| 2020/0129013 | A1 | 4/2020 | Mitchell et al. | |
| 2020/0131707 | A1 | 4/2020 | Mitchell et al. | |
| 2020/0232166 | A1 | 7/2020 | Rouse et al. | |
| 2021/0292973 | A1* | 9/2021 | Rouse | D21H 27/30 |
| 2022/0154400 | A1* | 5/2022 | Wei | D21H 27/02 |

FOREIGN PATENT DOCUMENTS

| | | | | |
|---|---|---|---|---|
| CN | 1946902 | A | 4/2007 | |
| CN | 1946903 | A | 4/2007 | |
| CN | 104116454 | B | 6/2017 | |
| DE | 9300201 | U1 | 6/1994 | |
| DE | 102008053858 | A1 | 5/2010 | |
| EP | 1319749 | A1 | 6/2003 | |
| EP | 2002058 | B1 | 6/2012 | |
| EP | 2513372 | B1 | 3/2014 | |
| GB | 1374198 | A | 11/1974 | |
| GB | 2574744 | A | 12/2019 | |
| JP | 4202872 | A2 | 7/1992 | |
| JP | 4202892 | A2 | 7/1992 | |
| JP | 5321190 | A2 | 12/1993 | |
| JP | 5331792 | A2 | 12/1993 | |
| JP | 7197400 | A | 8/1995 | |
| JP | 10102392 | A | 4/1998 | |
| KR | 20050002715 | A | 1/2005 | |
| KR | 100547492 | B1 | 1/2006 | |
| KR | 100547592 | B1 | 1/2006 | |
| KR | 20090036284 | A | 4/2009 | |
| KR | 100933462 | B1 | 12/2009 | |
| KR | 20100070240 | A | 6/2010 | |
| KR | 20110060510 | A | 6/2011 | |
| MX | 2010001159 | A | 7/2011 | |
| WO | 9606223 | A1 | 2/1996 | |
| WO | 07004757 | A1 | 1/2007 | |
| WO | 07059789 | A1 | 5/2007 | |
| WO | 07112916 | A1 | 10/2007 | |
| WO | 08003343 | A1 | 1/2008 | |
| WO | 08044860 | A1 | 4/2008 | |
| WO | 08063014 | A1 | 5/2008 | |
| WO | 10008331 | A1 | 1/2010 | |
| WO | 12010181 | A1 | 1/2012 | |
| WO | 14200455 | A1 | 12/2014 | |
| WO | 14200456 | A1 | 12/2014 | |
| WO | WO-2014200456 | A1 * | 12/2014 | D21H 11/04 |
| WO | 16195625 | A1 | 12/2016 | |
| WO | 16195627 | A1 | 12/2016 | |
| WO | 16195629 | A1 | 12/2016 | |
| WO | 18080492 | A1 | 5/2018 | |
| WO | 18156109 | A1 | 8/2018 | |

OTHER PUBLICATIONS

Ghosh, A. K., "Fundamentals of Paper Drying—Theory and Application from Industrial Perspective," Evaporation, Condensation and Heat Transfer, Sep. 12, 2011, pp. 535-582.

Haun, J. R. et al., "Fiber and Papermaking Characteristics of Bamboo," Technical Bulletin No. 1361, Agriculture Research Service, USDA, Aug. 1966, pp. 1-19.

Horn, Richard A. and Vance C. Setterholm, "Fiber Morphology and New Crops," Internet web page "http://www.hort.purdue.edu/newcrop/proceedings1990/vl-270.html", pp. 1-9, posted Aug. 28, 1997, from Advances in New Crops, Timber Press, Portland, OR, J. Janick and J.E. Simon (eds.), 1990, pp. 270-275.

Hurter, Robert W., in "Nonwood Plant Fiber Characteristics" HurterConsult pp. 1-4 (Year: 2001).

Idarraga, G. et al., "Pulp and Paper from Blue Agave Waste from Tequila Production," Journal of Agricultural and Food Chemistry, vol. 47, No. 10, Sep. 4, 1999, pp. 4450-4455.

Iniguez-Covarrubias, G. et al., "Utilization of By-Products from the Tequila Industry. Part 2: Potential Value of Agave Tequilana Weber Azul Leaves," Bioresource Technology, vol. 77, No. 2, Jan. 4, 2001, pp. 101-108.

Jaouadi, M. et al., "A Study of the Physical and Mechanical Properties of Paper Made from *Agave americana* L. Fibers," Materials and Manufacturing Processes, vol. 26, No. 4, Apr. 22, 2011, pp. 567-572.

Kamthai, Suphat and Pratung Puthson, "Effect of Beating Revolution on Sweet Bamboo (*Dendrocalamus asper* Backer) Kraft Pulp Properties," CMU Journal, vol. 4, No. 2, 2005, pp. 137-147.

McLaughlin, Steven, in "Properties of Paper Made From Fibers of *Hesperaloe funifera* (Agavaceae)," Economic Botany, 54(20 pp. 192-196. (Year: 2000).

(56) References Cited

OTHER PUBLICATIONS

Morphology, Internet web page "http://www.inbar.int/publication/txt/tr18/MORPHOLOGY.htm", viewed and printed Mar. 31, 2011, pp. 1-3.
Protasio et al. in "Brazilian Lignocellulosic Wastes for Bioenergy Production: Characterization and Comparison with Fossil Fuels," BioResources 8(1), 1166-1185 (Year: 2013).
Sekyere, Daniel, "Potential of Bamboo (*Bambusa vulgaris*) As a Source of Raw Material for Pulp and Paper in Ghana," Ghana Journal of Forestry, vol. 1, 1994, pp. 49-56.
Sood, Y.V. et al., "Quality Improvement of Paper from Bamboo and Hardwood Furnish Through Fiber Fractionation," Journal of Scientific & Industrial Research, vol. 64, Apr. 2005, pp. 299-305.
Tamolang, Francisco N. et al., "Properties and Utilization of Philippine Erect Bamboos," Bamboo Research in Asia, proceedings of workshop, Singapore, May 28-30, 1980, pp. 189-200.
Zhao, Guanglei et al., "Replacement of Softwood Kraft Pulp with ECF-Bleached Bamboo Kraft Pulp in Fine Paper," BioResources, vol. 5, No. 3, 2010, pp. 1733 1744.

* cited by examiner

LAYERED TISSUE COMPRISING NON-WOOD FIBERS

RELATED APPLICATIONS

The present application is a continuation application and claims priority to U.S. patent application Ser. No. 16/483,115, filed on Aug. 2, 2019, now U.S. Pat. No. 11,053,643, which is a national-phase entry, under 35 U.S.C. § 371, of PCT Patent Application No. PCT/US17/18822, filed on Feb. 22, 2017, all of which are incorporated herein by reference.

BACKGROUND OF THE DISCLOSURE

Papermakers, and in particular tissue paper makers, have long sought to balance the strength and softness of paper products by treating or altering the papermaking furnish. For example, one common practice in the manufacture of tissue products is to provide two furnishes (or sources) of wood pulp fiber. Sometimes, a two-furnish system is used in which the first furnish comprises a wood pulp fiber having a relatively short fiber length, such as a hardwood kraft pulp fiber, and the second furnish is made of wood pulp fiber having a relatively long fiber length, such as softwood kraft pulp fiber. The short fiber furnish may be used to provide the finished product with a softer handfeel, while the long fiber furnish may be used to provide the finished product with strength.

While surface softness in tissue products is an important attribute, a second element in the overall softness is stiffness. Stiffness can be measured from the tensile slope of stress-strain tensile curve. The lower the slope the lower the stiffness and the better overall softness the product will display. Stiffness and tensile strength are positively correlated, however at a given tensile strength shorter fibers will display a greater stiffness than long fibers. While not wishing to be bound by theory, it is believed that this behavior is due to the higher number of hydrogen bonds required to produce a product of a given tensile strength with short fibers than with long fibers. Thus, easily collapsible, low coarseness long fibers, such as those provided by Northern Softwood Kraft (NSWK) fibers typically supply the best combination of durability and softness in tissue products when those fibers are used in combination with hardwood Kraft fibers such as Eucalyptus hardwood Kraft fibers. While Northern Softwood Kraft Fibers have a higher coarseness than Eucalyptus fibers their small cell wall thickness relative to lumen diameter combined with their long length makes them the ideal candidate for optimizing durability and softness in tissue.

Unfortunately, supply of NSWK is under significant pressure both economically and environmentally. As such, prices of NSWK fibers have escalated significantly creating a need to find alternatives to optimize softness and strength in tissue products. Another type of softwood fiber is Southern Softwood Kraft (SSWK) widely used in fluff pulp containing absorbent products such as diapers, feminine care absorbent products and incontinence products. Unfortunately while not under the same supply and environmental pressures as NSWK, fibers from SSWK are too coarse for tissue products and are unsuitable for making soft tissue products. While having long fiber length, the SSWK fibers have too wide a cell wall width and too narrow a lumen diameter and thus create stiffer, harsher feeing products than NSWK.

The tissue maker who is able to identify fibers having a desirable combination of fiber length and coarseness from fiber blends generally regarded as inferior with respect to average fiber properties may reap significant cost savings and/or product improvements. For example, the tissue maker may wish to make a tissue paper of superior strength without incurring the usual degradation in softness which accompanies higher strength. Alternatively, the papermaker may wish a higher degree of paper surface bonding to reduce the release of free fibers without suffering the usual decrease in softness which accompanies greater bonding of surface fibers. As such, a need currently exists for a tissue product formed from a fiber that will improve durability without negatively affecting other important product properties, such as softness.

SUMMARY OF THE DISCLOSURE

It has now been surprisingly discovered that the short, low-coarseness fiber fraction of the tissue making furnish may be substituted with non-wood fibers and more specifically non-wood cellulosic fibers having an average fiber length from about 1.0 to about 2.0 mm, without negatively affecting important tissue properties such as strength and stiffness. In some instances tissue product properties may actually be improved by substituting short, low-coarseness fiber with non-wood cellulosic fibers. For example, in one embodiment, the present invention provides a soft and durable tissue comprising from about 10 to about 50 percent non-wood cellulosic fiber and having a ratio of machine direction tensile strength (MD Tensile) to cross-machine direction tensile strength (CD Tensile) of less than about 2.0 and a geometric mean tear strength greater than about 12.0 N. Surprisingly, the foregoing properties are comparable or better than those observed in similarly manufactured tissue products consisting essentially of short wood pulp fibers and long, low-coarseness wood pulp fibers.

Accordingly, in one embodiment, the present disclosure provides a multi-layered tissue web comprising a fabric contacting fibrous layer and a non-fabric contacting, also referred to as the air-side layer, fibrous layer, wherein the fabric contacting fibrous layer comprises wood pulp fibers and the non-fabric contacting fibrous layer comprises a blend of non-wood cellulosic fibers and wood pulp fibers. Preferably the fabric contacting layer is substantially free of non-wood cellulosic fibers and the tissue web comprises from about 5 to about 30 weight percent non-wood cellulosic fibers. In a particularly preferred embodiment the fabric contacting fibrous layer comprises softwood kraft fibers and the non-fabric contacting fibrous layer comprises non-wood cellulosic fibers and hardwood kraft fibers.

In yet other embodiments the present disclosure provides a multi-layered tissue web comprising a fabric contacting fibrous layer and a non-fabric contacting fibrous layer, wherein the fabric contacting fibrous layer consists essentially of wood pulp fibers and is substantially free of non-wood cellulosic fibers and the non-fabric contacting fibrous layer comprises from about 5 to about 30 weight percent non-wood cellulosic fibers, the tissue web having a basis weight greater than about 20 grams per square meter (gsm) a MD:CD Tensile Ratio less than about 2.0 and a geometric mean tear strength greater than about 12.0 N.

In other embodiments the present invention provides a tissue product comprising at least one multi-layered tissue web having first and second outer layers and a middle layer disposed there-between, the web comprising from about 5 to about 30 weight percent non-wood cellulosic fibers having an average fiber length from about 1.0 to about 2.0 mm, the product having a MD:CD Tensile Ratio less than about 2.0, a geometric mean tensile (GMT) greater than about 700 g/3" and a MD Slope less than about 10.0 kg.

In still other embodiments the present disclosure provides a method of forming a tissue web comprising the steps of dispersing a wood pulp fiber and a non-wood cellulosic fiber in water to form a first fiber slurry, dispersing a wood pulp fiber to form a second fiber slurry, depositing the second fiber slurry onto a forming fabric, depositing the first fiber slurry adjacent to the second fiber slurry to form a wet web, dewatering the wet web to a consistency from about 20 to about 30 percent, and drying the wet web to a consistency of greater than about 90 percent thereby forming a dry tissue web, the dry tissue web comprising from about 5 to about 30 weight percent non-wood cellulosic fibers.

In yet other embodiments the present disclosure provides a method of modifying at least one cross-machine direction property of a tissue web comprising the steps of dispersing hardwood kraft pulp and a non-wood cellulosic fiber selected from the group consisting of *Hesperaloe funifera, Hesperaloe nocturna, Hesperaloe parviflova, Hesperaloe chiangii, Agave tequilana, Agave sisalana, Agave fourcroydes, Phyllostachys edulis, Bambusa vulgaris, Phyllostachys nigra* and combinations thereof, in water to form a first fiber slurry, dispersing softwood kraft pulp fiber to form a second fiber slurry, depositing the second fiber slurry onto a forming fabric, depositing the first fiber slurry adjacent to the second fiber slurry to form a wet web, dewatering the wet web to a consistency from about 20 to about 30 percent, and drying the wet web to a consistency of greater than about 90 percent thereby forming a dry tissue web, the dry tissue web comprising from about 5 to about 30 weight percent non-wood cellulosic fibers and having a CD tensile, CD slope, CD tear or CD tensile energy absorption different than a similarly manufactured tissue web substantially free from non-wood cellulosic fiber. In certain embodiments first fiber slurry is not subject to refining and the second fiber slurry is optionally refined.

DESCRIPTIONS OF THE DRAWINGS

Figure 2:
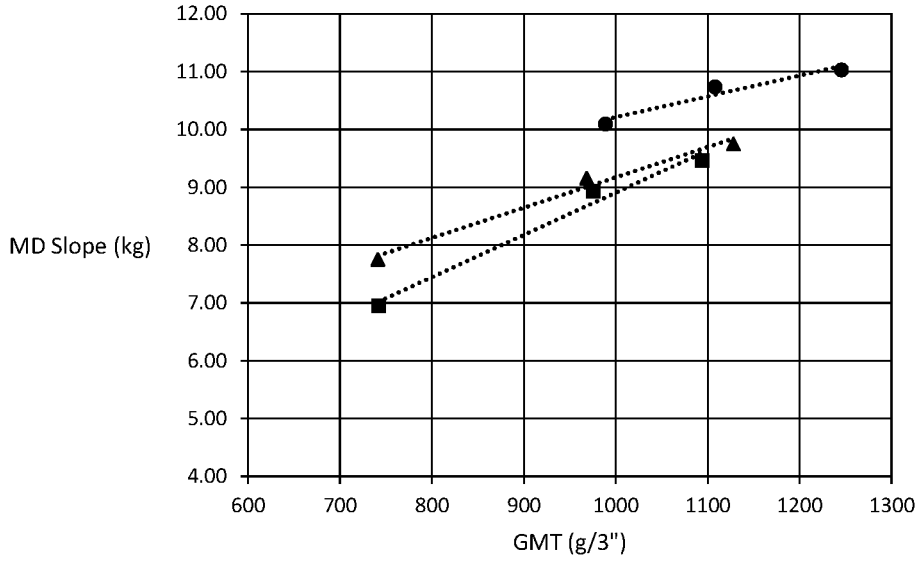
Figure 3:
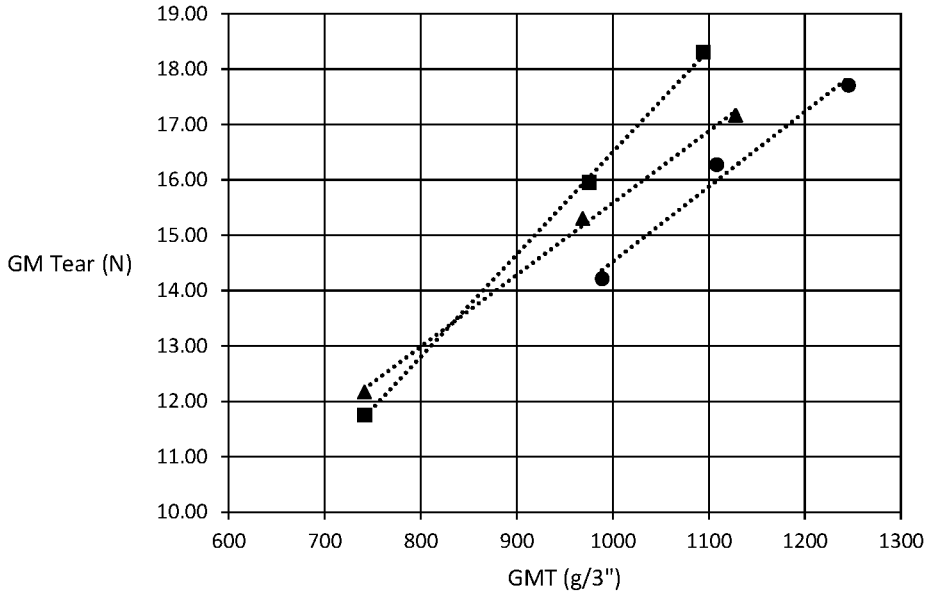

FIG. 1 is a graph of CD slope (y-axis) versus geometric mean tensile (GMT, x-axis) for three different tissue products manufactured at three different geometric mean tensile strengths, -●- are tissue products having three layers and comprising 40% NSWK and 60% EHWK, -▲- are tissue products having three layers and comprising 40% NSWK, 45% EHWK and 15% bamboo; and -■- are tissue products having three layers and comprising 40% NSWK, 30% EHWK and 30% bamboo;

FIG. 2 is a graph of MD slope (y-axis) versus geometric mean tensile (GMT, x-axis) for three different tissue products manufactured at three different geometric mean tensile strengths, -●- are tissue products having three layers and comprising 40% NSWK and 60% EHWK, -▲- are tissue products having three layers and comprising 40% NSWK, 45% EHWK and 15% bamboo; and -■- are tissue products having three layers and comprising 40% NSWK, 30% EHWK and 30% bamboo; and FIG. 3 is a graph of GM tear (y-axis) versus geometric mean tensile (GMT, x-axis) for three different tissue products manufactured at three different geometric mean tensile strengths, -●- are tissue products having three layers and comprising 40% NSWK and 60% EHWK, -▲- are tissue products having three layers and comprising 40% NSWK, 45% EHWK and 15% bamboo; and -●- are tissue products having three layers and comprising 40% NSWK, 30% EHWK and 30% bamboo.

DEFINITIONS

As used herein, the term "Average Fiber Length" means the length weighted average fiber length (LWAFL) of fibers determined utilizing OpTest Fiber Quality Analyzer, model FQA-360 (OpTest Equipment, Inc., Hawkesbury, ON). According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard OpTest Fiber Quality Analyzer fiber analysis test procedure. The weighted average fiber length may be expressed by the following equation:

$$\sum_{x_i=0}^{k}(x_i \times n_i)/n$$

where k=maximum fiber length
$x_i$=fiber length
$n_i$=number of fibers having length $x_i$
n=total number of fibers measured.

As used herein, the term "Coarseness" means the fiber mass per unit of unweighted fiber length reported in units of milligrams per one hundred meters of unweighted fiber length (mg/100 m) as measured using a suitable fiber coarseness measuring device such as the above OpTest Fiber Quality Analyzer. The coarseness of the pulp is an average of three coarseness measurements of three fiber specimens taken from the pulp. The operation of the analyzer for measuring coarseness is similar to the operation for measuring fiber length described above.

As used herein the term "Fiber" means an elongate particulate having an apparent length greatly exceeding its apparent width. More specifically, and as used herein, fiber means such fibers suitable for a papermaking process and more particularly the tissue paper making process.

As used herein the term "Cellulosic Fiber" means a fiber composed of or derived from cellulose.

As used herein, the term "Long Cellulosic Fibers" means a cellulosic fiber having an average fiber length greater than 1.2 mm and more preferably greater than about 1.5 mm and still more preferably greater than about 1.8 mm, such as from about 1.2 to about 3.0 mm and more preferably from about 1.5 to about 2.5 mm.

As used herein the term "Short Cellulosic Fibers" means a cellulosic fiber having an average length less than about 1.2 mm, such as from about 0.4 to about 1.2 mm, such as from about 0.5 to about 0.75 mm, and more preferably from about 0.6 to about 0.7 mm. One example of short cellulosic fibers are hardwood pulp fibers, which may be derived from hardwoods selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore and Beech.

As used herein the term "Non-Wood Cellulosic Fiber" means a fibers derived from non-wood plants including, for example, non-wood plants in the genus *Hesperaloe* in the family Agavaceae including, such as *H. funifera, H. nocturna, H. parviflova, and H. changii*, non-wood plants in the genus *Agave*, of the family Asparagaceae including, for example *A. tequilana, A. sisalana* and *A. fourcroydes* and non-wood plants in the genus *Phyllostachys* or *Bambusa*, of the family Poaceae including, for example, *Phyllostachys edulis, Bambusa vulgaris* and *Phyllostachys nigra* variant Henon.

As used herein, the term "Tissue Product" means products made from tissue webs and includes, bath tissues, facial tissues, paper towels, industrial wipers, foodservice wipers, napkins, medical pads, and other similar products.

As used herein, the term "Tissue Web" means a fibrous sheet material suitable for use as a tissue product.

As used herein, the term "Ply" means a discrete product element. Individual plies may be arranged in juxtaposition to each other. The term may refer to a plurality of web-like components such as in a multi-ply facial tissue, bath tissue, paper towel, wipe, or napkin.

As used herein, the term "Layer" means a plurality of strata of fibers, chemical treatments, or the like, within a ply.

As used herein, the terms "Layered," "Multi-Layered," and the like, refer to fibrous sheets prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein the term "Basis Weight" means the bone dry weight per unit area of a tissue and is generally expressed as grams per square meter (gsm). Basis weight is measured using TAPPI test method T-220. While basis weight may be varied, tissue products prepared according to the present invention and comprising one, two or three plies, generally have a basis weight greater than about 30 gsm, such as from about 30 to about 60 gsm and more preferably from about 35 to about 45 gsm.

As used herein the term "Caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa). The caliper of a tissue product may vary depending on a variety of manufacturing processes and the number of plies in the product, however, tissue products prepared according to the present invention generally have a caliper greater than about 500 μm, more preferably greater than about 575 μm and still more preferably greater than about 600 μm, such as from about 500 to about 800 μm and more preferably from about 600 to about 750 μm.

As used herein the term "Sheet Bulk" refers to the quotient of the caliper (generally having units of μm) divided by the bone dry basis weight (generally having units of gsm). The resulting sheet bulk is expressed in cubic centimeters per gram (cc/g). Through-air dried tissue products prepared according to the present invention generally have a sheet bulk greater than about 8 cc/g, more preferably greater than about 10 cc/g and still more preferably greater than about 12 cc/g, such as from about 8 to about 20 cc/g and more preferably from about 12 to about 18 cc/g. Creped wet pressed tissue products prepared according to the present invention generally have a sheet bulk greater than about 7 cc/g, more preferably greater than about 9 cc/g, such as from about 7 to about 10 cc/g.

As used herein, the term "Geometric Mean Tensile" (GMT) refers to the square root of the product of the machine direction tensile strength and the cross-machine direction tensile strength of the tissue product. While the GMT may vary, tissue products prepared according to the present invention generally have a GMT greater than about 500 g/3", more preferably greater than about 600 g/3" and still more preferably greater than about 800 g/3", such as from about 500 to about 1,200 g/3".

As used herein, the term "Slope" refers to the slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams (g) or kilograms (kg).

As used herein, the term "Geometric Mean Slope" (GM Slope) refers to the square root of the product of machine direction slope and cross-machine direction slope. GM Slope generally is expressed in units of kilograms (kg). While the GM Slope may vary, tissue products prepared according to the present invention generally have a GM Slope less than about 10.0 kg, more preferably less than about 8.0 kg and still more preferably less than about 6.0 kg.

As used herein, the term "Stiffness Index" refers to GM Slope (having units of kg), divided by GMT (having units of g/3") multiplied by 1,000. While the Stiffness Index may vary, tissue products prepared according to the present invention generally have a Stiffness Index less than about 10.0 and more preferably less than about 8.0, such as from about 6.0 to about 10.0.

As used herein, the term "Geometric Mean Tensile Energy Absorption" (GM TEA) refers to the square root of the product MD TEA and CD TEA, which are measured in the course of determining tensile strength as described below. GM TEA has units of $gm*cm/cm^2$.

As used herein the term "Substantially Free" when used in reference to a given layer of a multi-layered fibrous web means the given layer comprises less than about 0.25 percent of the subject fiber, by weight of the layer. The foregoing amounts of fiber are generally considered negligible and do not affect the physical properties of the layer. Moreover the presence of negligible amounts of subject fibers in a given layer generally arise from fibers disposed in an adjacent layer, and have not been purposefully disposed in a given layer. For example where a given layer of a multi-layered tissue web is said to be substantially free of wood pulp fibers, the given layer generally comprises less than about 0.25 percent wood pulp fiber, by weight of the layer.

DETAILED DESCRIPTION OF THE DISCLOSURE

The present invention provides multi-layered tissue webs, and tissue product comprising the same, the multi-layered webs comprising wood fibers and non-wood cellulosic fibers where the non-wood cellulosic fibers are selectively deposited in one or more outer layers of the multi-layered web. Surprisingly disposing non-wood cellulosic fibers in the outer layers, even in relatively modest amounts, alters the machine and/or cross-machine direction properties of the resulting web, such that MD:CD tensile ratio may be reduced. For example, in one embodiment, the present invention provides a method of manufacturing a tissue web comprising the steps of dispersing hardwood kraft pulp and a non-wood cellulosic fiber in water to form a first fiber slurry, dispersing softwood kraft pulp fiber to form a second fiber slurry, depositing the second fiber slurry onto a forming fabric, depositing the first fiber slurry adjacent to the second fiber slurry to form a wet web, dewatering the wet web to a consistency from about 20 to about 30 percent, and drying the wet web to a consistency of greater than about 90 percent thereby forming a dry tissue web, the dry tissue web comprising from about 5 to about 30 weight percent non-wood cellulosic fibers and having a MD:CD tensile ratio less than about 2.0. In particularly preferred embodiments the first fiber slurry is not refined, that is neither the hardwood kraft pulp nor the non-wood cellulosic fibers are refined. The second fiber slurry may optionally be refined to modify the strength of the resulting tissue web.

Tissue webs and products of the present invention generally comprise at least about 5.0 weight percent non-wood cellulosic fibers and more preferably at least about 10 weight percent, such as from about 5.0 to about 30 percent and more preferably from about 10 to about 25 weight percent. In particularly preferred embodiments the inventive tissue products comprise a multi-layered web comprising a first layer, such as a fabric contacting layer, and a second layer, such as an air layer, where the first layer comprises non-wood cellulosic fiber and wood pulp fibers, preferably short wood fibers, and the second layer comprises wood pulp fibers and is substantially free from non-wood cellulosic fibers.

Non-wood cellulosic fibers useful in the present invention are generally derived from non-wood plants in the genus *Hesperaloe* in the family Agavaceae including, for example *H. funifera, H. nocturna, H. parviflova*, and *H. changii*, non-wood plants in the genus *Agave*, of the family Asparagaceae including, for example *A. tequilana, A. sisalana* and *A. fourcroydes* and non-wood plants in the genus *Phyllostachys* or *Bambusa*, of the family Poaceae including, for example, *Phyllostachys edulis, Bambusa vulgaris* and *Phyllostachys nigra* variant Henon. Preferably the non-wood cellulosic fiber has an average fiber length greater than about 1.0 mm, more preferably greater than about 1.2 mm and still more preferably greater than about 1.4 mm, such as an average fiber length from about 1.0 to about 3.0 mm and more preferably from about 1.2 to about 2.8 mm. In certain embodiments the tissue webs and products may comprise two or more different non-wood cellulosic fibers.

In particularly preferred embodiments the non-wood cellulosic fiber is a bamboo fiber derived from one or more bamboo fiber species selected from the group consisting of *Acidosasa* Sp., *Ampleocalamus* Sp., *Arundinaria* Sp., *Bambusa* Sp., *Bashania* Sp., *Borinda* Sp., *Brachystachyum* Sp., *Cephalostachyum* Sp., *Chimonobambusa* Sp., *Chusquea* Sp., *Dendrocalamus* Sp., *Dinochloa* Sp., *Drepanostachyum* Sp., *Eremitis* Sp., *Fargesia* Sp., *Gaoligongshania* Sp., *Gelidocalamus* Sp., *Gigantochloa* Sp., *Guadua* Sp., *Hibanobambusa* Sp., *Himalayacalamus* Sp., *Indocalamus* Sp., *Indosasa* Sp., *Lithachne* Sp., *Melocanna* Sp., *Menstruocalamus* Sp., *Nastus* Sp., *Neohouzeaua* Sp., *Neomicrocalamus* Sp., *Ochlandra* Sp., *Oligostachyum* Sp., *Olmeca* Sp., *Otatea* Sp., *Oxytenanthera* Sp., *Phyllostachys* Sp., *Pleioblastus* Sp., *Pseudosasa* Sp., *Raddia* Sp., *Rhipidodadum* Sp., *Sasa* Sp., *Sasaella* Sp., *Sasamorpha* Sp., *Schizostachyum* Sp., *Semiarundinaria* Sp., *Shibatea* Sp., *Sinobambusa* Sp., *Thamnocalamus* Sp., *Thyrsostachys* Sp., and *Yushania* Sp.

Tissue webs and products made in accordance with the present disclosure are formed from a stratified fiber furnish producing layers within the web or product. Stratified base webs can be formed using equipment known in the art, such as a multi-layered headbox. For example, in certain embodiments, the tissue products may be prepared from multi-layered webs having a first outer layer, a middle layer and a second outer layer. In one embodiment the first and second outer layers may comprise non-wood cellulosic fiber and short cellulosic fiber, such as hardwood pulp fibers. The short cellulosic fibers can be mixed, if desired, with paper broke in an amount up to about 10 percent by weight and/or long cellulosic fiber in an amount up to about 10 percent by weight. The middle layer, which is generally positioned in between the first outer layer and the second outer layer may comprise wood fibers, and more preferably long, low coarseness wood pulp fibers, such as Northern softwood kraft pulp fibers (NSWK). Preferably the middle layer is substantially free from non-wood cellulosic fibers.

In other embodiments the non-wood cellulosic fibers are utilized in the tissue web as a replacement for short wood fibers such as hardwood kraft pulp fibers and more specifically Eucalyptus kraft fibers. In one particular embodiment, non-wood cellulosic fibers are incorporated into a multi-layered web having an air contacting layer (non-fabric contacting layer) and a fabric contacting layer where the air contacting layer comprises a blend of hardwood fibers and non-wood cellulosic fibers and the fabric contacting layer comprises long wood fibers. In the foregoing embodiment the non-wood cellulosic fiber may be added to the air contacting layer such that the total web comprises about 5.0 to about 30 percent, by total weight of the web, non-wood cellulosic fibers. Further, it may be preferred to selectively dispose the non-wood cellulosic fibers in the air layer such that the fabric contacting layer is substantially free from non-wood cellulosic fibers.

In a particularly preferred embodiment, the present disclosure provides a tissue web having modified machine and/or cross-machine direction physical properties and a MD:CD tensile ratio less than about 2.0. For example, the invention provides a tissue product having a GMT greater than about 500 g/3", such as from about 500 to about 1,200 g/3", and more preferably from about 700 to about 1,000 g/3", a MD:CD tensile ratio less than about 2.0, such as from about 1.5 to about 2.0 and more preferably from about 1.6 to about 1.80 and a reduced MD Slope, such as a MD Slope less than about 10.0 kg, and more preferably less than about 8.0 kg, such as from about 6.0 to about 10.0 kg and more preferably from about 6.0 to about 8.0 kg.

In other embodiments, the addition of non-wood fibers to one or more outer layers of a multi-layered tissue web may alter the CD Slope and in some instances may increase the CD Slope, compared to a similarly manufactured tissue web that is substantially free from non-wood fibers. For example, a tissue multi-layered web comprising from about 10 to about 50 percent non-wood fiber, where the non-wood fiber is selectively incorporated in one or more outer layers may have a CD Slope from about 4.5 to about 6.0 kg.

In still other embodiments, the present disclosure provides tissue products having enhanced durability, such as improved tear strength. For example, tissue products prepared as described herein may have a geometric mean tear (GM tear) greater than about 12.0 N and more preferably greater than about 14.0 N and still more preferably greater than about 16.0 N, such as from about 12.0 to about 20.0 at geometric mean tensile strengths from about 700 to about 1,200 g/3".

The increase in durability is generally achieved without a corresponding increase in stiffness, such that the instant tissue products are durable, yet flexible and soft. For example, tissue products prepared as described herein may have a GM Slope less than about 8.0 and more preferably less than about 7.0, such as from about 5.0 to about 8.0. The foregoing GM Slopes are generally achieved at GMTs from about 700 to about 1,200 g/3" and more preferably from about 750 to about 1,000 g/3" yielding Stiffness Indexes less than about 9.0, and more preferably less than about 8.0 and still more preferably less than about 7.0, such as from about 6.0 to about 9.0.

Webs prepared as described herein may be converted into either single or multi-ply rolled tissue products that have improved properties over the prior art. In one embodiment the present disclosure provides a rolled tissue product comprising a spirally wound tissue web having at least two layers wherein the air contacting layer comprises at least about 5 percent, by weight of the web, non-wood cellulosic fiber and wherein the tissue web has a bone dry basis weight greater than about 35 gsm, a sheet bulk greater than about 10 cc/g and a Stiffness Index less than about 9.0.

The tissue webs may also be incorporated into tissue products that may be either single- or multi-ply, where one or more of the plies may be formed by a multi-layered tissue web having non-wood cellulosic fiber selectively incorporated in one of its layers. In one embodiment the tissue product is constructed such that the non-wood cellulosic fibers are brought into contact with the user's skin in-use. For example, the tissue product may comprise two multi-layered through-air dried webs wherein each web comprises a fabric contacting fibrous layer substantially free from non-wood cellulosic fiber and a non-fabric contacting fibrous layer comprising non-wood cellulosic fiber. The webs are plied together such that the outer surface of the tissue product is formed from the fabric contacting fibrous layers of each web, such that the surface brought into contact with the user's skin in-use comprises non-wood cellulosic fiber.

If desired, various chemical compositions may be applied to one or more layers of the multi-layered tissue web to further enhance softness and/or reduce the generation of lint or slough. For example, in some embodiments, a wet strength agent can be utilized to further increase the strength of the tissue product when wet. As used herein, a "wet strength agent" is any material that when added to pulp fibers can provide a resulting web or sheet with a wet geometric tensile strength to dry geometric tensile strength ratio in excess of about 0.1. Typically these materials are termed either "permanent" wet strength agents or "temporary" wet strength agents. As is well known in the art, temporary and permanent wet strength agents may also sometimes function as dry strength agents to enhance the strength of the tissue product when dry.

Wet strength agents may be applied in various amounts depending on the desired characteristics of the web. For instance, in some embodiments, the total amount of wet strength agents added can be between about 1 to about 60 pounds per ton (lbs/T), in some embodiments between about 5 to about 30 lbs/T, and in some embodiments between about 7 to about 13 lbs/T of the dry weight of fibrous material. The wet strength agents can be incorporated into any layer of the multi-layered tissue web.

A chemical debonder can also be applied to soften the web. Specifically, a chemical debonder can reduce the amount of hydrogen bonds within one or more layers of the web, which results in a softer product. Depending on the desired characteristics of the resulting tissue product, the debonder can be utilized in varying amounts. For example, in some embodiments, the debonder can be applied in an amount between about 1 to about 30 lbs/T, in some embodiments between about 3 to about 20 lbs/T, and in some embodiments, between about 6 to about 15 lbs/T of the dry weight of fibrous material. The debonder can be incorporated into any layer of the multi-layered tissue web.

Any material capable of enhancing the soft feel of a web by disrupting hydrogen bonding can generally be used as a debonder in the present invention. In particular, as stated above, it is typically desired that the debonder possess a cationic charge for forming an electrostatic bond with anionic groups present on the pulp. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty and carboxylic acid derivatives, mono and polysaccharide derivatives, polyhydroxy hydrocarbons, etc. For instance, some suitable debonders are described in U.S. Pat. Nos. 5,716,498, 5,730,839, 6,211,139, 5,543,067, and WO/0021918, all of which are incorporated herein in a manner consistent with the present disclosure.

Still other suitable debonders are disclosed in U.S. Pat. Nos. 5,529,665 and 5,558,873, both of which are incorporated herein in a manner consistent with the present disclosure. In particular, U.S. Pat. No. 5,529,665 discloses the use of various cationic silicone compositions as softening agents.

Tissue webs of the present disclosure can generally be formed by any of a variety of papermaking processes known in the art. Preferably the tissue web is formed by through-air drying and be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multi-ply tissue products, the separate plies can be made from the same process or from different processes as desired.

For example, in one embodiment, tissue webs may be creped through-air dried webs formed using processes known in the art. To form such webs, an endless traveling forming fabric, suitably supported and driven by rolls, receives the layered papermaking stock issuing from the headbox. A vacuum box is disposed beneath the forming fabric and is adapted to remove water from the fiber furnish to assist in forming a web. From the forming fabric, a formed web is transferred to a second fabric, which may be either a wire or a felt. The fabric is supported for movement around a continuous path by a plurality of guide rolls. A pick up roll designed to facilitate transfer of web from fabric to fabric may be included to transfer the web.

Preferably the formed web is dried by transfer to the surface of a rotatable heated dryer drum, such as a Yankee dryer. The web may be transferred to the Yankee directly from the throughdrying fabric or, preferably, transferred to an impression fabric which is then used to transfer the web to the Yankee dryer. In accordance with the present disclosure, the creping composition of the present disclosure may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. The creping web as it is formed further reduces internal bonding within the web and increases softness. Applying the creping composition to the web during creping, on the other hand, may increase the strength of the web.

In other embodiments, the base web is formed by an uncreped through-air drying process such as those described, for example, in U.S. Pat. Nos. 5,656,132 and 6,017,417, both of which are hereby incorporated by reference herein in a manner consistent with the present disclosure. The uncreped through-air drying process may comprise a twin wire former having a papermaking headbox which injects or deposits a furnish of an aqueous suspension of wood fibers onto a plurality of forming fabrics, such as an outer forming fabric and an inner forming fabric, thereby forming a wet tissue web. The forming process may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of at least about 20 percent, more specifically between about 20 to about 40 percent, and more specifically about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.). The wet web is then transferred from the forming fabric to a transfer fabric while at a solids consistency of between about 10 to about 35 percent and, particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric. The wet tissue web is then transferred from the transfer fabric to a throughdrying fabric.

While supported by the throughdrying fabric, the wet tissue web is dried to a final consistency of about 94 percent or greater by a throughdryer. The drying process can be any noncompressive drying method which tends to preserve the bulk or thickness of the wet web including, without limitation, throughdrying, infra-red radiation, microwave drying, etc. Because of its commercial availability and practicality, throughdrying is well known and is one commonly used means for noncompressively drying the web for purposes of this invention. Suitable throughdrying fabrics include, without limitation, fabrics with substantially continuous machine direction ridges whereby the ridges are made up of multiple warp strands grouped together, such as those disclosed in U.S. Pat. No. 6,998,024. Other suitable throughdrying fabrics include those disclosed in U.S. Pat. No. 7,611,607, which is incorporated herein in a manner consistent with the present disclosure, particularly the fabrics denoted as Fred (t1207-77), Jetson (t1207-6) and Jack (t1207-12). The web is preferably dried to final dryness on the throughdrying fabric, without being pressed against the surface of a Yankee dryer, and without subsequent creping.

Additionally, webs prepared according to the present disclosure may be subjected to any suitable post processing including, but not limited to, printing, embossing, calendering, slitting, folding, winding, combining with other tissue webs, and the like. Post processing of the web generally results in a tissue product that is intended for use by a consumer.

Test Methods

Sheet Bulk

Sheet Bulk is calculated as the quotient of the dry sheet caliper (μm) divided by the basis weight (gsm). Dry sheet caliper is the measurement of the thickness of a single tissue sheet measured in accordance with TAPPI test methods T402 and T411 om-89. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63±0.15 mm (2.5±0.006 inches) in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the prescribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single ply basesheet. This is done by multiplying the single ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inches (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm*cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Multi-ply products were tested as multi-ply products and results represent the tensile strength of the total product. For example, a 2-ply product was tested as a 2-ply product and recorded as such. A basesheet intended to be used for a 2-ply product was tested as two plies and the tensile recorded as such. Alternatively, a single ply may be tested and the result multiplied by the number of plies in the final product to get the tensile strength.

EXAMPLES

Base sheets were made using a through-air dried papermaking process commonly referred to as "uncreped through-air dried" ("UCTAD") and generally described in U.S. Pat. No. 5,607,551, the contents of which are incorporated herein in a manner consistent with the present invention. Initially, northern softwood kraft (NSWK) pulp was dispersed in a pulper for 30 minutes at 4 percent consistency at about 100° F. The NSWK pulp was then transferred to a dump chest and subsequently diluted to approximately 3 percent consistency. The NSWK pulp was refined at about 1 HP-days/MT as set forth in Table 2, below. The softwood fibers were added to the middle side layer in the 3-layer tissue structure. The virgin NSWK fiber content contributed approximately 40 percent of the final sheet weight.

Eucalyptus hardwood kraft (EHWK) pulp was dispersed in a pulper for 30 minutes at about 4 percent consistency at about 100° F. The EHWK pulp was then transferred to a dump chest and subsequently diluted to about 3 percent consistency. The EHWK was not refined.

The non-wood cellulosic fibers were bamboo kraft pulp, which had the following properties:

TABLE 1

| Non-wood cellulosic fiber | Average Fiber Length (mm) | Coarseness (mg/100 m) |
|---|---|---|
| Bamboo Kraft Pulp | 1.30 | 9.17 |

Bamboo pulp fibers were dispersed in a pulper for 30 minutes at 4 percent consistency at about 100° F. The bamboo pulp was then transferred to a dump chest and subsequently diluted to approximately 3 percent consistency. The bamboo pulp was not refined.

In certain instances starch (Redibond 2038A, Ingredion Incorporated, Englewood, Colo.) was added to each furnish layer prior to formation of the web. Starch was added to the machine chest where it was mixed prior to the headbox. Starch addition levels are set forth in Table 2.

The pulp fibers from the machine chests were pumped to the headbox at a consistency of about 0.1 percent. Pulp fibers from each machine chest were sent through separate manifolds in the headbox to create a 3-layered tissue structure. The specific furnish layer splits are set forth in Table 2.

TABLE 2

| Sample | Middle Layer (Wt. %) | Outer Layers (Wt. %) | | Redibond 2038A Starch (kg/MT) | Refining (min.) |
|---|---|---|---|---|---|
| Control 1 | NSWK (40%) | EHWK (60%) | — | — | 3 |
| Control 2 | NSWK (40%) | EHWK (60%) | — | 1 | 3 |
| Control 3 | NSWK (40%) | EHWK (60%) | — | 2 | 3 |

TABLE 2-continued

| Sample | Middle Layer (Wt. %) | Outer Layers (Wt. %) | | Redibond 2038A Starch (kg/MT) | Refining (min.) |
|---|---|---|---|---|---|
| Inventive 1 | NSWK (40%) | EHWK (45%) | Bamboo (15%) | — | 0 |
| Inventive 2 | NSWK (40%) | EHWK (45%) | Bamboo (15%) | 2 | 0 |
| Inventive 3 | NSWK (40%) | EHWK (45%) | Bamboo (15%) | 4 | 0 |
| Inventive 4 | NSWK (40%) | EHWK (30%) | Bamboo (30%) | — | 0 |
| Inventive 5 | NSWK (40%) | EHWK (30%) | Bamboo (30%) | 2 | 0 |
| Inventive 6 | NSWK (40%) | EHWK (30%) | Bamboo (30%) | 4 | 0 |

The tissue web was formed on a Voith Fabrics TissueForm V forming fabric, vacuum dewatered to approximately 25 percent consistency and then subjected to rush transfer when transferred to the transfer fabric. The layer splits, by weight of the web, are detailed in Table 2, above. The transfer fabric was the fabric described as t1207-11 (commercially available from Voith Fabrics, Appleton, Wis.). The web was then transferred to a through-air drying fabric. Transfer to the through-drying fabric was done using vacuum levels of greater than 10 inches of mercury at the transfer. The web was then dried to approximately 98 percent solids before winding.

The base sheet webs were converted into rolled bath products by calendering using a conventional polyurethane/steel calender comprising a 4 P&J polyurethane roll on the air side of the sheet and a standard steel roll on the fabric side. The finished product comprised a single ply of base sheet. The finished products were subjected to physical testing, the results of which are summarized in Tables 3 and 4, below.

TABLE 3

| Code | Basis Weight (gsm) | Caliper (microns) | Sheet Bulk (cc/g) | MD:CD Tensile Ratio | MD:CD Slope Ratio | GMT | GM Slope | Stiffness Index |
|---|---|---|---|---|---|---|---|---|
| Control 1 | 36.5 | 476 | 13.1 | 2.07 | 2.22 | 989 | 6.80 | 6.88 |
| Control 2 | 36.3 | 499 | 13.8 | 1.98 | 2.19 | 1108 | 7.27 | 6.57 |
| Control 3 | 37.1 | 534 | 14.4 | 1.98 | 2.11 | 1245 | 7.61 | 6.11 |
| Inventive 1 | 36.7 | 506 | 13.8 | 1.83 | 1.57 | 741 | 6.19 | 8.36 |
| Inventive 2 | 37.1 | 492 | 13.3 | 1.78 | 1.82 | 968 | 6.82 | 7.04 |
| Inventive 3 | 36.7 | 525 | 14.3 | 1.78 | 1.86 | 1128 | 7.15 | 6.34 |
| Inventive 4 | 36.3 | 455 | 12.5 | 1.72 | 1.28 | 742 | 6.17 | 8.31 |
| Inventive 5 | 36.3 | 498 | 13.7 | 1.80 | 1.69 | 975 | 6.88 | 7.05 |
| Inventive 6 | 36.2 | 489 | 13.5 | 1.65 | 1.66 | 1094 | 7.37 | 6.74 |

TABLE 4

| Code | CD Tensile (g/3") | CD Slope (kg) | MD Tensile (g/3") | MD Slope (kg) | GM TEA (g*cm/cm$^2$) | GM Tear (N) |
|---|---|---|---|---|---|---|
| Control 1 | 690 | 4.60 | 1421 | 10.10 | 10.67 | 14.22 |
| Control 2 | 790 | 4.93 | 1556 | 10.74 | 12.11 | 16.28 |
| Control 3 | 885 | 5.25 | 1753 | 11.03 | 13.97 | 17.71 |
| Inventive 1 | 549 | 4.95 | 1002 | 7.76 | 7.74 | 12.17 |
| Inventive 2 | 727 | 5.10 | 1292 | 9.16 | 10.72 | 15.30 |
| Inventive 3 | 846 | 5.26 | 1503 | 9.76 | 13.25 | 17.17 |
| Inventive 4 | 567 | 5.49 | 972 | 6.95 | 7.84 | 11.76 |
| Inventive 5 | 729 | 5.30 | 1305 | 8.93 | 11.06 | 15.95 |
| Inventive 6 | 853 | 5.75 | 1404 | 9.46 | 12.92 | 18.31 |

The foregoing represents several examples of inventive tissue products prepared according to the present disclosure. In other embodiments, such as a first embodiment, the present invention provides a tissue product comprising at least one multi-layered tissue web comprising a first air contacting layer and a second fabric contacting layer, wherein the first air contacting layer comprises from about 5 to about 30 weight percent, by weight of the web, non-wood cellulosic fibers and the tissue product has a geometric mean tensile from about 500 to about 1,200 g/3" and a MD:CD Tensile ratio less than about 2.0.

In a second embodiment the present invention provides the tissue product of the first embodiment wherein the fabric contacting layer is substantially free from non-wood cellulosic fiber.

In a third embodiment the present invention provides the tissue product of the first or second embodiments wherein the non-wood cellulosic fiber is derived from a non-wood plant selected from the group consisting of *Hesperaloe funifera, Hesperaloe nocturna, Hesperaloe parviflova, Hesperaloe chiangii, Agave tequilana, Agave sisalana, Agave fourcroydes, Phyllostachys edulis, Bambusa vulgaris, Phyllostachys nigra* and combinations thereof.

In a fourth embodiment the present invention provides the tissue product of any one of the first through third embodiments wherein the non-wood cellulosic fiber has an average fiber length from about 1.0 to about 3.0 mm.

In a sixth embodiment the present invention provides the tissue product of any one of the first through fifth embodiments having a GMT from about 700 to about 1,000 g/3" and a MD Slope from about 6.0 to about 10.0 kg.

In a seventh embodiment the present invention provides the tissue product of any one of the first through sixth embodiments having a GMT from about 700 to about 1,000 g/3" and a Stiffness Index from about 6.0 to about 9.0.

In an eighth embodiment the present invention provides the tissue product of any one of the first through seventh embodiments wherein the product has a MD:CD slope ratio less than 2.0, such as from about 1.5 to about 2.0 and more preferably from about 1.5 to about 1.75.

In a ninth embodiment the present invention provides the tissue product of any one of the first through eighth embodiments wherein the tissue product has a GM Tear from about 12 to about 20 N.

In a tenth embodiment the present invention provides the tissue product of any one of the first through ninth embodiments wherein the tissue product has a GM TEA greater than about 7.0 g*cm/cm$^2$, such as from about 7.0 to about 14.0 g*cm/cm$^2$ and more preferably from about 9.0 to about 12.0 g*cm/cm$^2$.

In an eleventh embodiment the present invention provides the tissue product of the first through tenth embodiments wherein the product has a MD:CD tensile ratio from about 1.50 to about 1.80.

In a twelfth embodiment the present invention provides the tissue product of the first through eleventh embodiments wherein the product has a GM Slope from about 6.0 to about 10.0 kg.

In a thirteenth embodiment the present invention provides the tissue product of the first through twelfth embodiments wherein the non-wood cellulosic fiber is derived from a non-wood plant selected from *Phyllostachys edulis, Bambusa vulgaris, Phyllostachys nigra* and combinations thereof and has an average fiber length from about 1.2 to about 1.6 mm.

In a fourteenth embodiment the present invention provides a tissue product comprising at least one multi-layered tissue web comprising a first and a second outer layer and a middle layer disposed therebetween, wherein the outer layers comprise from about 5 to about 30 percent, by weight of the web, non-cellulosic fiber and the tissue product has a geometric mean tensile from about 500 to about 1,200 g/3" and a MD:CD Tensile ratio less than about 2.0.

In a fifteenth embodiment the present invention provides the tissue product of the fourteenth embodiment wherein the middle layer is substantially free from non-wood cellulosic fiber.

In a sixteenth embodiment the present invention provides the tissue product of the fourteenth or fifteenth embodiments wherein the non-wood cellulosic fiber has an average fiber length from about 1.0 to about 3.0 mm.

In a seventeenth embodiment the present invention provides the tissue product of any one of the fourteenth through sixteenth embodiments wherein the tissue product has a MD:CD slope ratio less than 2.0, such as from about 1.5 to about 2.0 and more preferably from about 1.5 to about 1.75.

In an eighteenth embodiment the present invention provides the tissue product of any one of the fourteenth through seventeenth embodiments wherein the tissue product has a GM Tear greater than about 12 N, such as from about 12 to about 20 N.

In a nineteenth embodiment the present invention provides a method of forming a soft and durable wet laid tissue product comprising the steps of (a) providing a first fiber furnish consisting essentially of short wood pulp fibers and non-wood cellulosic fibers; (b) providing a second fiber furnish consisting essentially of long wood pulp fibers; (c) depositing the first and second fiber furnish on a forming fabric to form a wet tissue web; (d) partially dewatering the wet tissue web; (e) drying the tissue web; and (f) converting the tissue web into a tissue product, wherein the product comprises from 5 to 30 weight percent non-wood cellulosic fiber and has a geometric mean tensile from about 500 to about 1,200 g/3" and a MD:CD Tensile ratio less than 2.0.

In a twentieth embodiment the present invention provides the method of the nineteenth embodiment wherein the converting step comprises calendering, embossing, printing, or combinations thereof.

In a twenty-first embodiment the present invention provides the method of the nineteenth or twentieth embodiments further comprising the step of refining the second fiber furnish and wherein the first fiber furnish is not refined.

What is claimed is:

1. A tissue product comprising at least one multi-layered tissue web having a first outer layer, a second outer layer and a middle layer disposed therebetween, wherein the first and the second outer layers comprise unrefined non-wood cellulosic fiber and the middle layer is substantially free from non-wood cellulosic fiber, the tissue product comprising at least 10 percent, by weight of the product, unrefined non-wood cellulosic fiber and having a geometric mean tensile (GMT) of about 700 g/3" or greater and geometric mean slope (GM Slope) from about 6.0 to about 10.0 kg.

2. The tissue product of claim 1 wherein the first outer layer and the second outer layer each comprise from about 5 to about 30 percent, by weight of the layer, unrefined non-wood cellulosic fiber.

3. The tissue product of claim 1 comprising from 10 to about 50 percent, by weight of the product, unrefined non-wood cellulosic fiber.

4. The tissue product of claim 1 wherein the unrefined non-wood cellulosic fiber has an average fiber length from about 1.0 to about 3.0 mm.

5. The tissue product of claim 1 having a GMT from about 700 to about 1,000 g/3".

6. The tissue product of claim 1 having a Stiffness Index from about 6.0 to about 9.0.

7. The tissue product of claim 1 having a GMT from about 700 to about 1,000 g/3" and a Stiffness Index from about 6.0 to about 9.0.

8. The tissue product of claim 1 having a geometric tensile energy absorption (GM TEA) from about 9.0 to about 12.0 g*cm/cm2.

9. The tissue product of claim 1 having a MD:CD slope ratio from about 1.5 to about 1.75.

10. The tissue product of claim 1 having a MD:CD Tensile ratio less than about 2.0.

11. The tissue product of claim 1 having a geometric mean tear (GM Tear) greater than about 12 N.

12. The tissue product of claim 1 having a GMT from about 700 to about 1,000 g/3" and a MD Slope from about 6.0 to about 10.0 kg.

13. The tissue product of claim 1 wherein the unrefined non-wood cellulosic fiber is derived from a non-wood plant selected from the group consisting of *Hesperaloe funifera, Hesperaloe nocturna, Hesperaloe parviflova, Hesperaloe chiangii, Agave tequilana, Agave sisalana, Agave fourcroydes, Phyllostachys edulis, Bambusa vulgaris, Phyllostachys nigra* and combinations thereof.

14. The tissue product of claim 13 wherein the unrefined non-wood cellulosic fiber has an average fiber length from about 1.0 to about 3.0 mm.

* * * * *